US005682629A

United States Patent [19]

Bortoluzzi

[11] Patent Number: 5,682,629

[45] Date of Patent: Nov. 4, 1997

[54] DIVAN-BED WHICH CAN BE CONVERTED VIA OPERATING MEANS OF THE CONTINUOUS-BALANCING TYPE AND WITH VARIATION OF THE HEIGHT OF THE SEAT

[75] Inventor: Guido Bortoluzzi, Belluno, Italy

[73] Assignee: Flou S.p.A., Meda, Italy

[21] Appl. No.: 630,885

[22] Filed: Apr. 2, 1996

[30] Foreign Application Priority Data

Apr. 5, 1995 [IT] Italy ..... MI95A0680

[51] Int. Cl.[6] ..... A47C 17/17

[52] U.S. Cl. ..... 5/37.1; 5/47; 5/48; 5/18.1

[58] Field of Search ..... 5/17, 18.1, 37.1, 5/41, 47, 48

[56] References Cited

U.S. PATENT DOCUMENTS

| | | | |
|---|---|---|---|
| 1,815,877 | 7/1931 | Thum | 5/47 |
| 2,297,526 | 9/1942 | Boyer et al. | 5/47 |
| 2,907,053 | 10/1959 | Fox | 5/18.1 X |
| 3,751,740 | 8/1973 | Belk | 5/37.1 |
| 3,856,347 | 12/1974 | Bell et al. | 5/47 X |
| 4,204,288 | 5/1980 | Villa et al. | 5/18.1 X |
| 4,756,034 | 7/1988 | Stewart . | |

FOREIGN PATENT DOCUMENTS

| | | | |
|---|---|---|---|
| 0097130 | 12/1983 | European Pat. Off. | 5/41 |
| 1 529 585 | 12/1969 | Germany . | |

*Primary Examiner*—Michael F. Trettel
*Attorney, Agent, or Firm*—Herbert Dubno; Yuri Kateshov

[57] ABSTRACT

Divan-bed includes a fixed frame resting on the floor, a backrest and a seat, in which at least two longitudinal sides of the frame are formed by rails guiding a carriage movable in translation along a horizontal plane, the carriage having pivotably hinged on it the backrest and a shaped lever, the opposite ends of which are rotationally connected, respectively, to the backrest via a rod and to the seat, there also being provided a mechanism cooperating with an adjusting device for fixing the relative position of the backrest and seat.

9 Claims, 4 Drawing Sheets

DIVAN-BED WHICH CAN BE CONVERTED VIA OPERATING MEANS OF THE CONTINUOUS-BALANCING TYPE AND WITH VARIATION OF THE HEIGHT OF THE SEAT

DESCRIPTION

1. Field of the Invention

The present invention relates to a divan-bed which can be converted via operating means of the continuous-balancing type and with variation of the height of the seat.

2. Background of the Invention

In the production technology for divan and/or chairbeds, it is known of the need to have mechanisms which can be easily and inexpensively made and which allow the configuration of the divan to be varied by conversion from the normally closed arrangement to a fully extended bed arrangement.

Numerous types of mechanisms which allow this conversion from divan to bed are also known, but have some drawbacks including the difficulty of operation, particularly for those users who are not experts or have a limited amount of physical strength. The difficulty of operation results from the lack of equilibrium of the divan in the various intermediate positions upon changing from the initial configuration to the final configuration.

Furthermore, with the known mechanisms it is not possible to vary easily the relative position of the backrest and seat and lock them in preselected intermediate positions, or, where possible, the divans are equipped with electric or pneumatic operating devices which are subject to wear and which require costly installation and maintenance operations.

OBJECTS OF THE INVENTION

The principle object of the present invention is to provide a divan-bed which is always balanced in its various positions, so as to make conversion easy and effortless for users who are inexpert or have little physical strength.

Still another object of the invention is to provide the divan-bed able to assume intermediate positions of greater comfort both in the divan configuration and in the bed configuration; and Still another object is to provide the divan bed which is able to be locked/released easily in/from the intermediate positions.

SUMMARY OF THE INVENTION

These results are obtained by the present invention, according to which a divan-bed comprises a fixed frame resting on the floor, a backrest and seat, in which at least two longitudinal sides of the frame are formed by rails guiding a carriage movable in translation along a horizontal plane, the carriage having pivotably hinged on it the backrest and a shaped lever, the opposite ends of which are rotationally connected, respectively, to the backrest via a rod and to the seat, there also being provided adjusting means fixed to the carriage and locking means cooperating with the adjusting means for fixing the relative position of the backrest and seat and their inclination with respect to the horizontal plane of the floor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
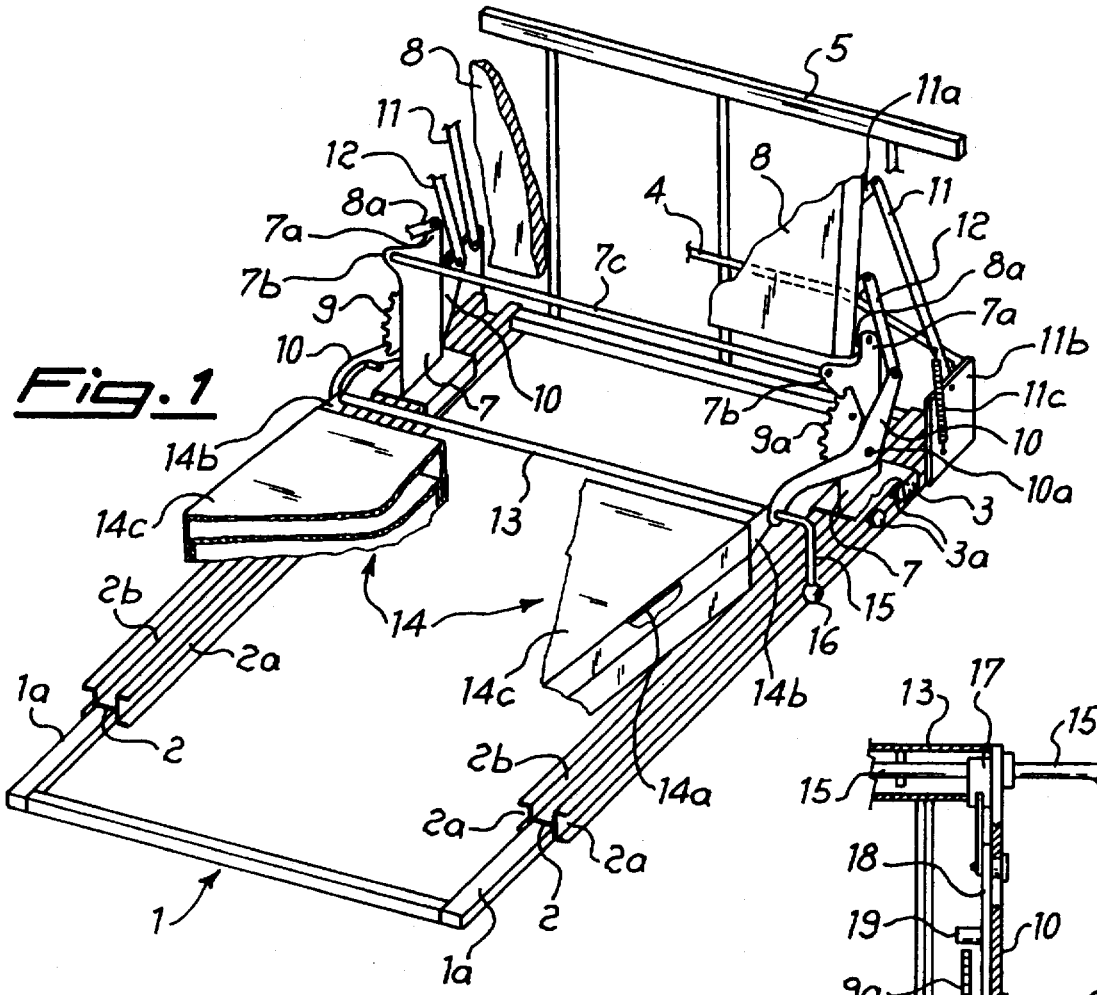
FIG. 1 is a schematic perspective view of the frame of the divan-bed according to the invention.

As shown in FIG. 1, the divan-bed according to the invention comprises a fixed frame 1 arranged so as to rest on the floor, the opposite longitudinal sides 1*a* of which are formed, over at least part of their overall length, by rails 2 with a cross-section forming a pair of opposite vertical guide channels 2*a* and a horizontal upper channel 2*b* inside which rollers 3*a* and 3*b*, respectively, of a carriage 3 are able to travel. The carriage therefore is movable in translation in the longitudinal direction with respect to the frame 1 itself.

The rear part of the frame 1 also has fixed to it a horizontal bar 4 extending in the transverse direction over the entire width of the frame, the purpose of which will become clear below, and a headboard 5.

Each movable carriage 3 has mounted on it a vertical flange 7, the top part of which is shaped in the manner of two extensions, a front extension 7*b* and rear extension 7*a*. The two front extensions 7*b* and rear flange 7 are connected together by a fixed bracing strut 7*c*, while the rear extensions 7*a* have rotationally connected to them eyelets 8*a* projecting from the backrest 8 of the divan. The backrest 8 therefore is pivotably hinged on the flange 7 of the movable carriage 3, relative to which it is able to rotate.

In the proximity of its top part, the backrest 8 is pivotably hinged on a first end 11*a* of a lever 11, the other end of which is pivotably hinged on a gusset 11*b* fixed to the rear part of the frame 1. A spring 11*c* is arranged between said lever 11 and gusset 11*b* in order to balance the weight of the backrest 8 during its movements described below.

The vertical flange 7 of the carriage 3 also has attached to it a fixed rack 9 in the form of a circle segment with radial notches 9*a* formed on its external circumference, and a shaped lever 10 hinged on a fixed pin 10*a* with a horizontal axis on which it is able to rotate.

The rear end of the shaped lever 10 is pivotably hinged on a first end of an additional rod 12, the other end of which is pivotably hinged on the backrest 8. The front end of the lever 10 is pivotably hinged on a tubular cross-piece 13 at the opposite ends of which there is hinged, by means of associated flanges 14b, the surface 14 forming the seat of the divan.

At the opposite ends of the tubular cross-piece 13 and coaxial with the latter there are arranged two levers 15 which terminate in a ball-grip 16 and which are located on the sides of the divan-bed in a position which can be easily reached by the user.

The levers 15 (FIG. 2) have keyed on them eccentric cams 17 operating a connecting rod 18 actuating a transverse pin 19 designed to be inserted into the notches 9a of the rack 9 for locking the divan in a preferred position.

The seat 14 of the divan is in turn formed by at least two opposite longitudinal guides 14a, the top part of which contains the support surface 14c, while the bottom part serves as a guide and for sliding and housing the footrest 18 which is able to pass from a totally retracted inside the seat to a position totally extracted therefrom.

Figure 5:
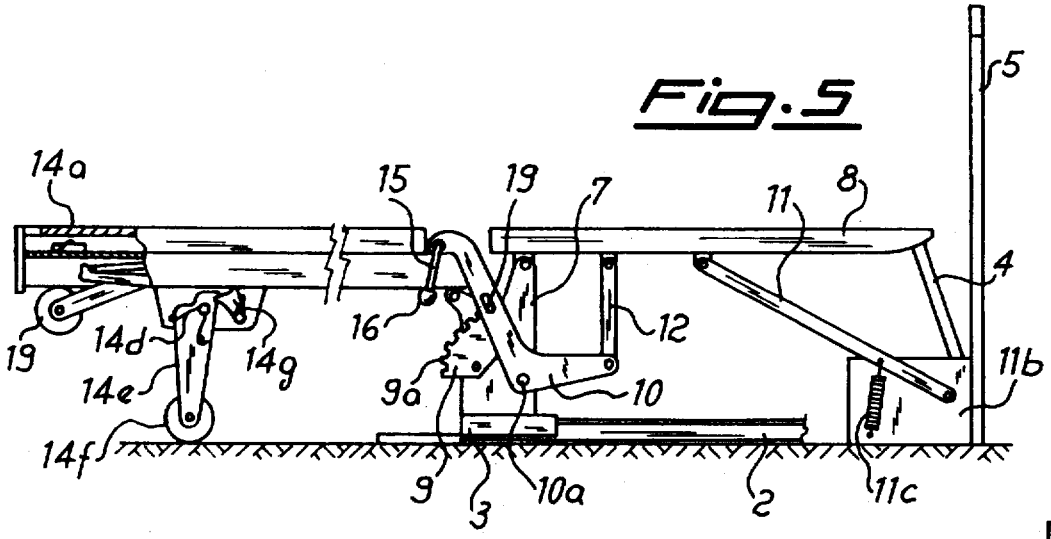
FIG. 5 is a partially sectioned side view of the divan folded down horizontally with the footrest still inserted in the seat.

The external surface of the guide 14a (FIG. 5) has hinged to it, via spring means 14d, an arm 14e supporting a wheel 14f for resting the seat 14 on the floor, the arm is lockable and releasable via a rotating pawl 14g.

More particularly, the footrest 18 consists of a frame, the opposite longitudinal flanks of which are formed by guides 18a (FIG. 4) which have attached to them wheels 19 mounted on a support arm 19a pivotably hinged at 19b on the guide 18a.

Figure 6:
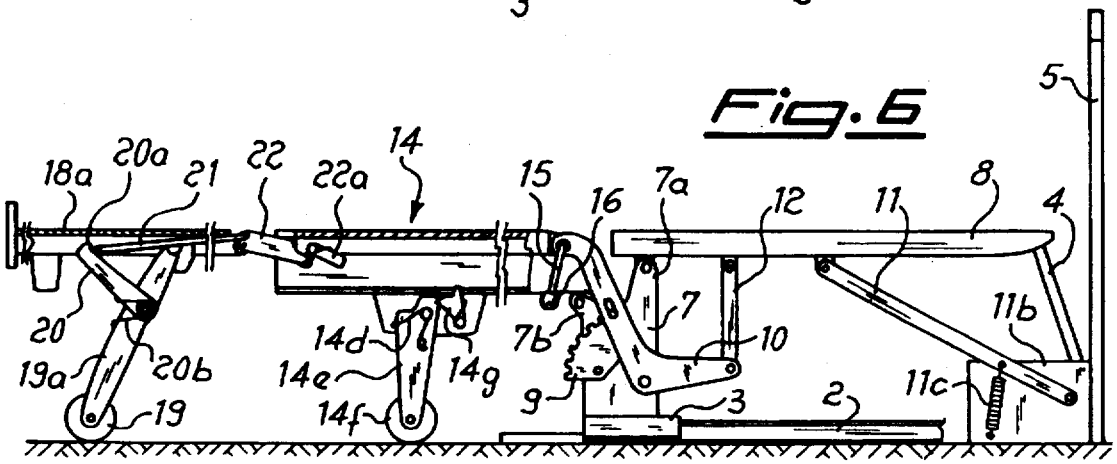
FIG. 6 is a partially sectioned side view of the frame totally extended in the bed position.

The arm 19a supporting the wheel 19 has pivotably hinged on it, via elastic recall means 20b (FIG. 6), a second arm 20, the free end 20a of which is designed to engage with a horizontal pin 21a mounted on the inner end of a rod 21 (FIG. 3) sliding on the inner surface of the guide 18a and moved in translation by a cam 22 connecting the opposite end of the rod 21 to the guide 14a of the seat 14.

Figure 3:
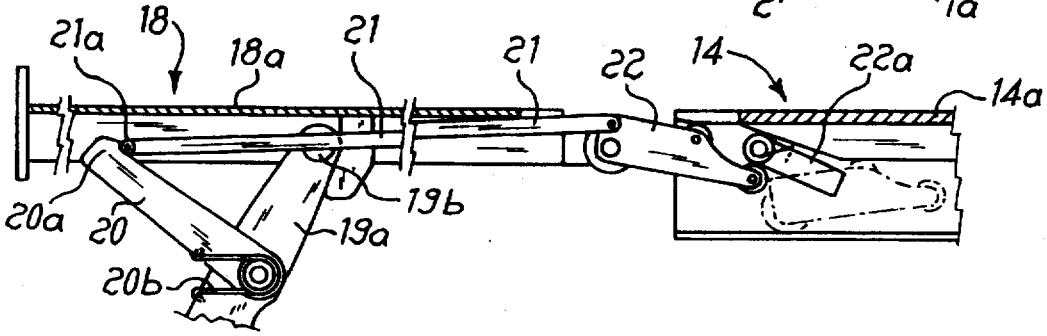
FIG. 3 is a detail of the mechanism for locking/releasing the wheel supporting the footrest.

The cam 22 is associated with locking means 22a known per se and shown only in schematic form in FIG. 3, by means of which it is possible to lock the footrest 18 so as to prevent it from being extracted.

Figure 4:
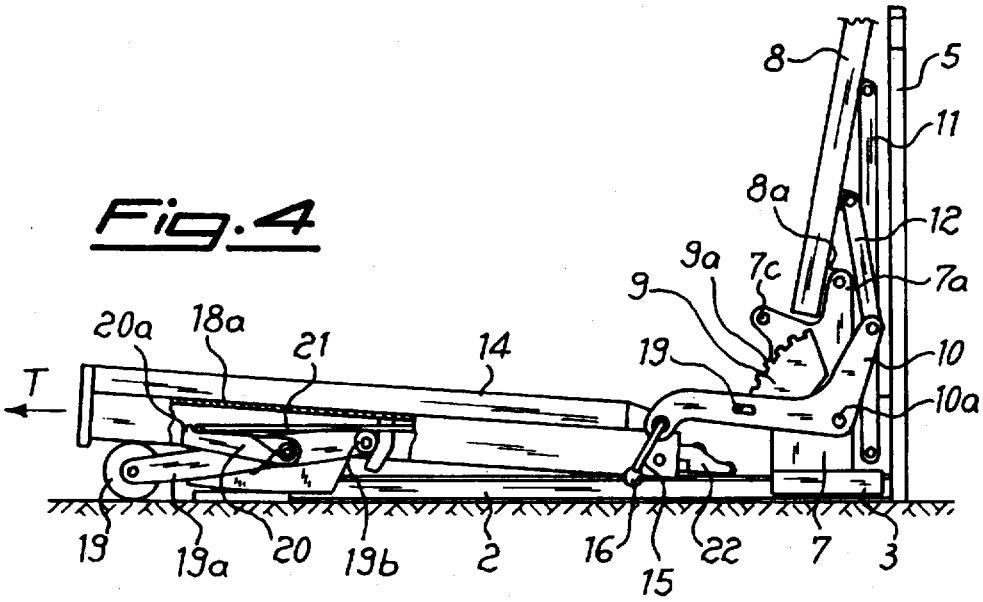
FIG. 4 shows a side view of the frame according to FIG. 1.

Starting from the divan configuration shown in FIG. 4, where the footrest 18 is fully retracted inside the seat 14, the backrest 8 is in the erect position and the carriage 3 is pushed fully backwards towards the headboard 5, operation of the divan-bed is as follows:

- the lever 15 is rotated in an anti-clockwise direction, causing rotation of the eccentric cam 17 by means of which the connecting rod 18 is actuated, pulling the pin 19 in the radial direction so that it comes out of the notch 9a of the rack 9, releasing the frame operating mechanism which is free to vary its position;
- pulling the free end of the seat in the direction of the arrow T pulls outwards the carriages 3 which, guided by the longitudinal rails 2 of the frame 1, move forward parallel, being attached together by the strut 7c;
- translation of the carriages 3 causes rotation, in a clockwise direction, of the backrest 8 which, rotating about the pins 7a, causes rotation of the lever 11, against the action of the spring 11c and pushes downwards the levers 12 which, pushing against the rear end of the shaped levers 10, causes rotation thereof in a clockwise direction about the fixed pins 10a;
- the rotation of the levers 10 causes raising of the front ends which, during the forwards travel of the carriages 3, causes the simultaneous raising of the seat 14 and the downwards rotation of the arms 14e carrying the wheels 14f for resting on the ground;
- at the end of rotation, which has been performed in conditions of continuous equilibrium owing to the action of the spring 11c, the backrest 8 is totally lowered in the horizontal position and rests on the rear transverse bar 4, the seat 14 is totally extracted and raised with the upper surface coplanar with the surface of the backrest and resting on the transverse strut 7c;
- at this point it is possible to rotate the lever 15 into the initial position, re-inserting the pin 19 into the rack 9 and locking the mechanism;
- subsequently it is possible to pull the footrest outwards and upwards so as to release the stop means 22a—continuing extraction of the footrest, the end-of-travel device is reached, causing rotation of the cam 22 and consequent engagement of the arm 20 of the wheel 19 which in the meantime is rotated towards the arm recalled by the spring 20b, with the pin 21a of the rod 21: in this way the frame is totally extended and locked in the horizontal position in the bed configuration.

Figure 2:
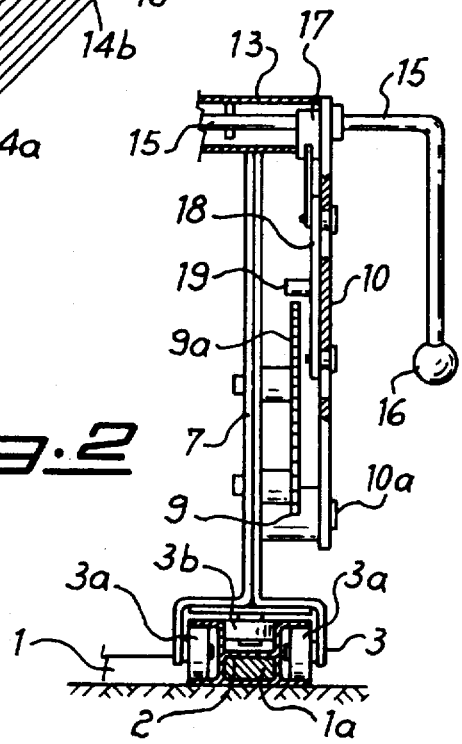
FIG. 2 shows a partially sectioned front view of the device for operating and locking the frame.

In order to close up the bed, returning to the divan configuration of FIG. 2, it is sufficient to perform the aforementioned operations in reverse.

Figure 7:
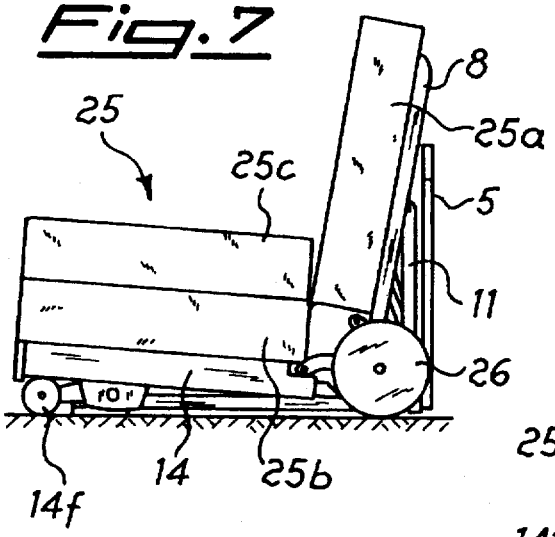
FIG. 7 is the divan-according to the invention with a foldable mattress.
Figure 8A:
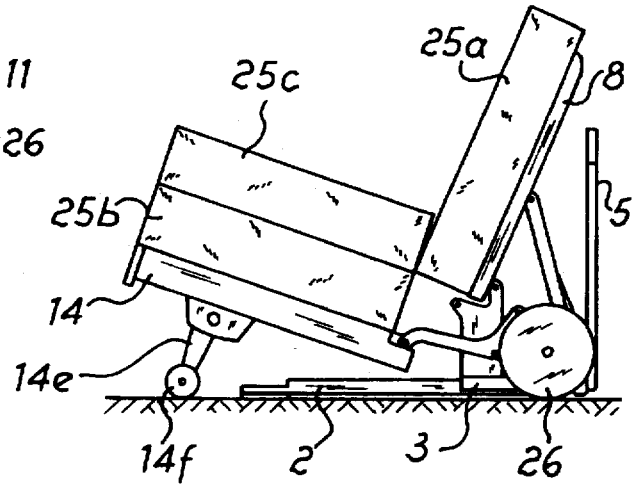
FIGS. 8*a* and 8*b* show the divan extended in intermediate positions in the divan configuration and bed configuration, respectively.
Figure 8B:
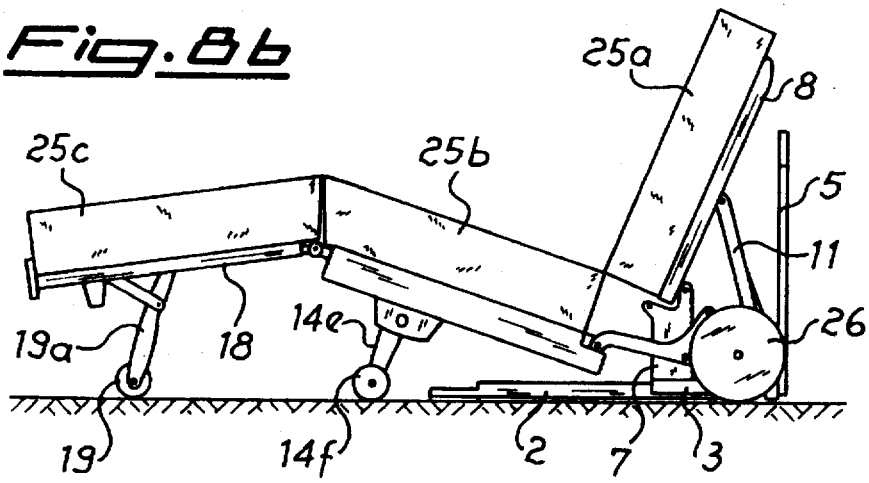
Figure 9:
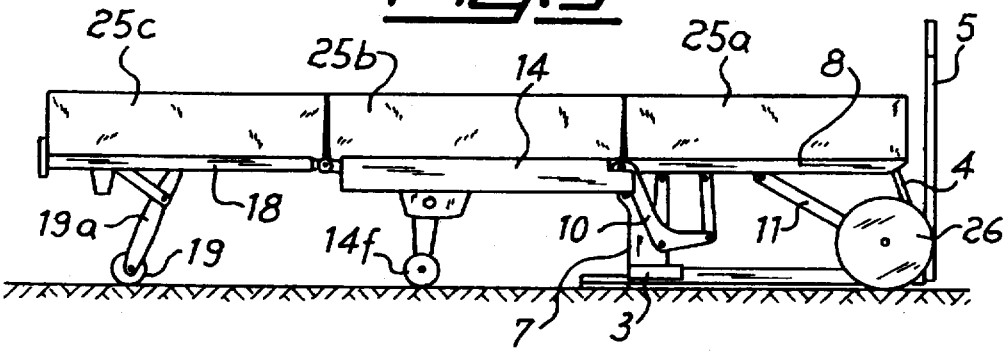
FIG. 9 is the divan totally extended in the flat bed configuration.

FIGS. 7–9 show the divan according to the invention completed with a foldable spring mattress 25; in the divan configuration the backrest part 25a (FIGS. 7, 8a) rests on the transverse strut 7c and is supported by the latter also during rotations of the backrest 8 so as to avoid undesirable slipping of the mattress itself.

As illustrated, it is possible to arrange the divan (FIG. 7) in positions with different variable relative inclinations of the backrest 8, 25a and seat 14,25b (FIG. 8a): in this case it is sufficient to rotate the lever 15, causing extraction of the pin 19 from the rack 9, and rotate the backrest into the desired position where the lever 15 is rotated in the opposite direction, locking again the frame.

As illustrated in FIGS. 8a and 8b, this positional variation may be performed both with the footrest retracted, i.e. in the divan configuration, and with the footrest 18,25c extracted, i.e. in the bed configuration; in this latter case (FIG. 8b) these intermediate positions with the footrest and backrest inclined as required may be easily achieved, also starting from the totally horizontally extended position, i.e. returning to the initial configuration, since the continuous equilibrium of the frame requires a minimum additional force in order to obtain the positional variation.

From the figures it can be seen also that the divan may be provided with rear wheels 26 for displacing it from one place to another, said wheels being provided with stop means of the conventional type and hence not illustrated.

Figure 10A:
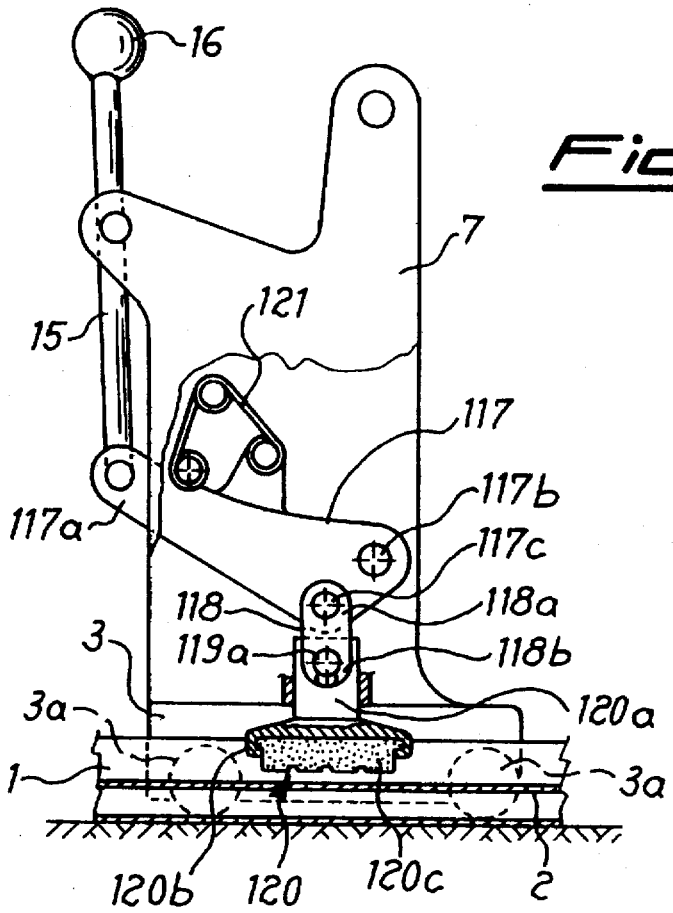
FIGS. 10*a* and 10*b* are embodiment of the devices for adjusting and locking the relative position of the backrest and seat according to the invention.
Figure 10B:
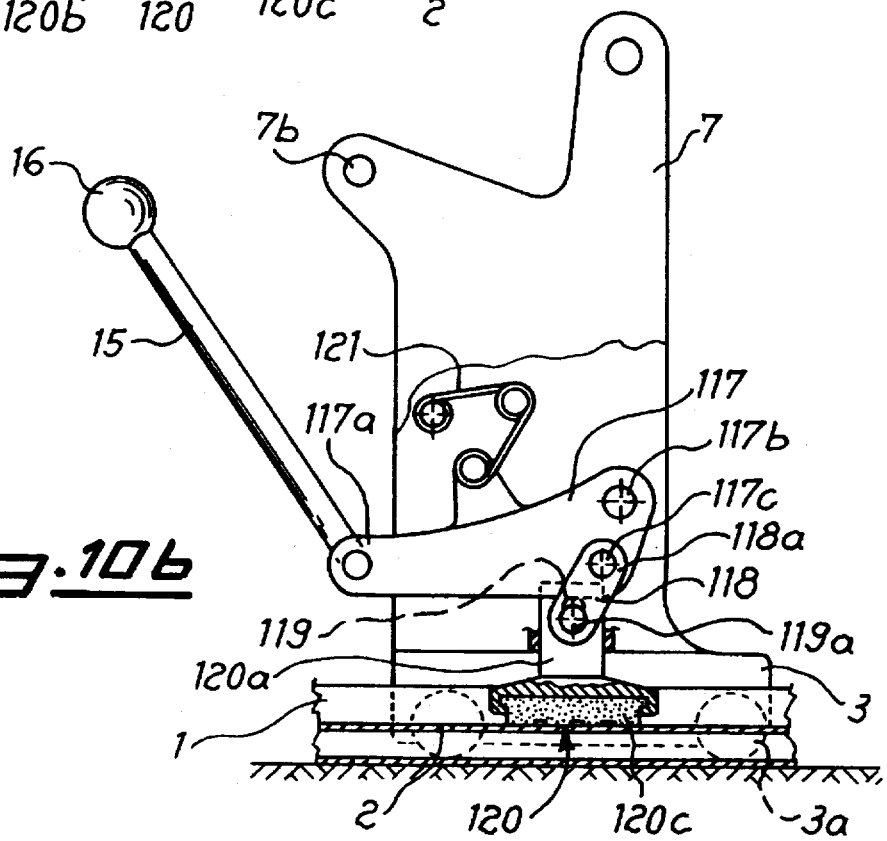

FIGS. 10a and 10b illustrate a different embodiment of the devices for adjusting and locking the relative position of the backrest and seat, whereby, in this case, a substantially continuous adjustment of the position is possible.

The devices are in fact designed such that each of the levers 15 is pivotably hinged on the free end 117a of a shaped lever 117, the other end of which is pivotably hinged via a pin 117b on the vertical flange 7 of the carriage 3.

The lever 117 also has pivotably hinged on it at 117c a first end 118a of a plate 118, the other end 118b of which causes the translatory movement of the rod 120a of a brake 120 comprising a shoe 120b housing a pad 120c made of friction material.

The eccentric lever 117 is also designed to act against the thrusting action of resilient means 121 (FIG. 10) and its travel designed to be limited by end-of-travel elements 119 integral with the pin 119a.

In this way, by rotating the lever 15 from a locking position (FIG. 10a), where the brake 120 is lowered into contact with the rail 2 and the carriage 3 is kept braked, into a released position (FIG. 10*b*), the plate 118 acts as a connecting rod which causes raising of the brake 120, allowing the relative position of the backrest and seat to be varied.

Bringing the lever 15 back into its normal position, the connecting rod causes the brake 120 to be lowered again and the carriage 3 is locked in the desired position.

Many variations may be introduced as regards the realization of the parts which make up the invention, without thereby departing from the protective scope of the present invention, as defined by the claims which follow.

I claim:

1. A divan-bed comprising:

a fixed frame including a pair of longitudinal parallel rails resting on the floor;

a pair of rigidly interconnected carriages movable along said rails in a horizontal plane between opposite extreme positions of the carriages;

a seat mounted on said carriages and displaceable therewith in said horizontal plane;

a backrest operatively connected with said seat and mounted pivotally about a first axis extending perpendicular to said rails on said frame upon displacement of said carriages between said extreme positions of the carriages which correspond respectively to a fully extended position of the divan-bed in which said seat and backrest lie in said horizontal plane and a folded position, each of the carriages being formed with:

a respective shaped lever pivotal about a respective axis parallel to said first axis and formed with a one end rotationally connected with the seat and the opposite end, a respective first rod rotatably connecting said opposite end of the shaped lever and the backrest, respective adjusting means for applying a plurality of relative angular positions between said seat and backrest while said carriages moving between said fully extended and folded positions of the divan-bed, and respective locking means for fixing each of said angular positions.

2. The divan-bed defined in claim 1 further comprising two spaced apart bars (11) mounted rotatably about a second axis parallel to the first axis on the fixed frame by one ends of the bars and hingedly engaging the backrest by the opposite ends of the bars to swing with the backrest upon displacing the carriages, and elastic means between said frame and the bars for biasing said backrest in a position corresponding to said fully extended position of the divan-bed.

3. The divan-bed defined in claim 1 wherein each of said carriage is formed with a flange (7) supporting the respective shaped lever and the respective adjusting and locking means, each of said adjusting means including a rack having a circle segment which is formed with an external circumference provided with a plurality of radial notches, each of said locking means including a respective eccentric cam (170 keyed to the respective shaped lever, a respective second rod (18) mounted on the eccentric cam and displaceable therewith and a respective pin (19) having a pin axis parallel to the first axis and mounted on the second rod and spaced from the cam.

4. The divan-bed defined in claim 3 further comprising a shaft (15) interconnecting the eccentric cams of the locking means and rotatable about a shaft axis extending parallel to the first axis to arcuately displace the pins of the locking means for engagement with the respective notches of the adjusting means upon actuating of said cams.

5. The divan-bed defined in claim 1 wherein said seat includes:

a pair of spaced apart longitudinal guides (14) parallel to said rails and bridged by a first cross-bar (13) and operatively connected with the shaped levers, a pair of spaced apart elongated arms (14*e*) each provided with a respective wheel on one end of the arm and mounted on the respective guide (14) by a respective opposite end of the arm to rotate between a rest and support positions of the arms, the arms extending in a vertical plane in the support position corresponding to the fully extended position of the divan-bed and lying substantially in the horizontal plane upon rotation of the arms in the rest position corresponding to the folded position of the divan, resilient means (14*d*) for biasing said arms in the support position, and closing means (14*g*) for securing the support position.

6. The divan-bed defined in claim 5 further comprising a footrest operatively connected with the seat and including a pair of respective longitudinal sides (18*a*) slidably received in said guides of the seat, so that said footrest is displaceable between extracted and closed positions thereof.

7. The divan-bed defined in claim 6 wherein said footrest further includes:

a respective pair of supports pivotally mounted on the respective side of the footrest between a respective rest and support positions by respective one ends of the supports, respective elastic means for fixing said support position in which said supports extend substantially in the vertical plane and wheels formed on opposite ends of the supports are in contact with a ground, and respective stop means for fixing said supports in the respective rest position in which said support lie substantially in the horizontal plane.

8. The divan-bed defined in claim 7 wherein each of the stop means includes a respective cam mechanism (22) mounted slidably fixed on the respective longitudinal side of footrest, a respective first link (21) mounted rotatably on the cam mechanism and movable generally in the horizontal plane upon displacement of the cam mechanism, a respective second link (20) mounted rotatably on the respective support by a one end and hinged on the respective first link by the opposite end to rotate about a respective horizontal axis, said second link extending substantially parallel to the respective support (19*a*) in the horizontal plane in the rest position of and extending substantially perpendicular to the respective support in the respective support position of the respective support.

9. The divan-bed defined in claim 1 further comprising a crossbar (118) extending parallel to the first axis and mounted on the shaped levers of the carriages for arcuate displacement, a pair of upright columns (120*a*) bridged by and rotatably connected with the crossbar to be displaced between upper and lower vertical positions thereof upon pivoting of the shaped levers, and a pair of brakes each mounted on the respective upright column and arresting the movement of the carriages in the lower position of the columns by engaging the longitudinal rails.

* * * * *